US007637408B2

(12) United States Patent
Takahashi et al.

(10) Patent No.: US 7,637,408 B2
(45) Date of Patent: Dec. 29, 2009

(54) DRIVING TOOL HAVING A TWO-PART FLYWHEEL

(75) Inventors: Yuji Takahashi, Anjo (JP); Shinji Hirabayashi, Anjo (JP)

(73) Assignee: Makita Corporation, Anjo-shi (JP)

( * ) Notice: Subject to any disclaimer, the term of this patent is extended or adjusted under 35 U.S.C. 154(b) by 27 days.

(21) Appl. No.: 12/000,174

(22) Filed: Dec. 10, 2007

(65) Prior Publication Data

US 2008/0257933 A1 Oct. 23, 2008

(30) Foreign Application Priority Data

Dec. 11, 2006 (JP) ..... 2006-333036

(51) Int. Cl.
*B25C 1/06* (2006.01)

(52) U.S. Cl. ..... 227/133; 227/131; 227/120

(58) Field of Classification Search ..... 227/133, 227/131, 120

See application file for complete search history.

(56) References Cited

U.S. PATENT DOCUMENTS 4,042,036 A * 8/1977 Smith et al. ..... 173/13
4,121,745 A 10/1978 Smith et al.
4,215,808 A * 8/1980 Sollberger et al. ..... 227/146
4,519,535 A * 5/1985 Crutcher ..... 227/131
4,721,170 A * 1/1988 Rees ..... 173/13
5,069,379 A 12/1991 Kerrigan
5,511,715 A * 4/1996 Crutcher et al. ..... 227/131
6,607,111 B2 * 8/2003 Garvis et al. ..... 227/131
2003/0192933 A1 * 10/2003 Pedicini et al. ..... 227/131
2003/0192934 A1 * 10/2003 Pedicini et al. ..... 227/131
2005/0218183 A1 10/2005 Berry et al.
2006/0091176 A1 * 5/2006 Cannaliato et al. ..... 227/8

* cited by examiner

*Primary Examiner*—Brian D Nash
(74) *Attorney, Agent, or Firm*—Oliff & Berridge, PLC

(57) ABSTRACT

It is an object of the present invention to increase durability of a driving tool. A representative driving tool comprises an elongated operating member that drives in a driving material and a drive mechanism that drives the operating member. The drive mechanism comprises a rotating flywheel and the flywheel includes an inner wheel and an outer wheel which are concentrically disposed to each other. The inner circumferential surface of the outer wheel is fitted on an outer circumferential surface of the inner wheel. The outer circumferential surface of the outer wheel directly contacts the operating member and thus, the rotational force of the flywheel is transmitted from the inner wheel to the operating member via the outer wheel and the drive mechanism linearly moves. A frictional force between the outer circumferential surface of the inner wheel and the inner circumferential surface of the outer wheel is set to be smaller than a frictional force between the outer circumferential surface of the outer wheel and the operating member. With such construction, when the operating member contacts the rotating flywheel, slippage is caused between the inner wheel and the outer wheel such that only a smaller frictional force may be produced between the inner wheel and the outer wheel. Therefore, stress which acts upon the inner wheel and the outer wheel can be alleviated and as a result, wear of the flywheel and the operating member can be reduced to increase the durability.

10 Claims, 7 Drawing Sheets

DRIVING TOOL HAVING A TWO-PART FLYWHEEL

BACKGROUND OF THE INVENTION

1. Field of the Invention

The present invention relates to a driving tool that drives in a driving material such as a nail by linearly driving an operating member via a flywheel.

2. Description of the Related Art

U.S. laid-open Patent Publication No. 2005/0218183 discloses an example of a flywheel-type driving tool using a flywheel as a drive mechanism for driving an operating member in the form of a driver. Generally, in a flywheel-type driving tool, the driver contacts the outer circumferential surface of the flywheel which is rotationally driven at high speed by a driving motor, so that the driver is linearly driven and strikes a driving material. Specifically, the rotational force of the flywheel is transmitted to the driver as linear motion by a frictional force caused by contact between the flywheel and the driver. However, when the flywheel and the driver contact, slippage is caused in the contact region, particularly in an early contact region. As a result, wear is caused. Therefore, in the above-mentioned known driving toot in order to reduce wear, the area of contact of the flywheel and the driver is increased. Specifically, a plurality of V-grooves are formed in the driver, and projections having a V-shaped section shaped to be engaged with the V-grooves of the driver are formed on the outer circumferential surface of the flywheel.

In the above-mentioned known driving tool, the side surface of the flywheel forms a power transmitting surface so that larger contact area can be provided. However, the wear reducing effect is not enough yet according to the known art and further improvement in durability is desired.

SUMMARY OF THE INVENTION

Accordingly, it is an object of the present invention to increase durability of a driving tool.

The above-described object can be achieved by a claimed invention. According to the present invention as defined in claim 1, a representative driving tool includes an operating member that drives in a driving material by reciprocating, and a drive mechanism that drives the operating member. The driving material according to the invention typically represents a nail, a staple, etc.

The drive mechanism includes a rotating flywheel and the flywheel includes an inner wheel and an outer wheel which are concentrically disposed. An inner circumferential surface of the outer wheel is fitted on an outer circumferential surface of the inner wheel. The outer circumferential surface of the outer wheel directly contacts the operating member, so that the rotational force of the flywheel is transmitted to the operating member from the inner wheel via the outer wheel to linearly move the operating member. Specifically, the flywheel has a double-layered structure in the radial direction, and characteristically, a frictional force between the outer circumferential surface of the inner wheel and the inner circumferential surface of the outer wheel is set to be smaller than a frictional force between the outer circumferential surface of the outer wheel and the operating member. The operating member may preferably be pressed against the outer circumferential surface of the outer wheel of the rotating flywheel by a rotatable pressure roller. Otherwise, the flywheel may be pressed against the operating member supported by a rotatable roller or the operating member may be pressed against between the outer circumferential surfaces of two opposed flywheels.

According to the invention, the frictional force between the inner wheel and the outer wheel is set to be smaller than the frictional force between the outer wheel and the operating member. With this construction, when the operating member contacts the rotating flywheel the outer wheel and the operating member between which a larger frictional force is produced are integrated together and slippage is caused between the inner wheel and the outer wheel such that only a smaller frictional force may be produced between the inner wheel and the outer wheel Therefore, stress which acts upon the inner wheel and the outer wheel can be alleviated and as a result, wear of the flywheel and the operating member can be reduced to increase the durability.

As one aspect of the invention, an elastic material may preferably be disposed on the outer circumferential surface of the outer wheel, and at least a contact region of the operating member which contacts the outer wheel is formed of metal. The elastic material may typically represent rubber, resin, urethane, etc., but it may also include any other materials which elastically deform by contact with the operating member.

With such construction, the elastic material elastically deforms according to the contour of the contact surface of the operating member when it contacts the operating member. Thus, the area of contact of the operating member and the elastic material is increased, so that the frictional force therebetween increases. As a result, the outer wheel and the operating member hardly cause slippage with respect to each other, or in other words, they are integrated together. Therefore, friction in the contact region is prevented or reduced and thereby the durability can be increased. Further, with the construction in which the elastic material contacts the operating member, it is not necessary to provide the operating member with unnecessarily high strength (wear resistance). Therefore, the contact region between the operating member and the elastic material can be formed, for example, of aluminum, so that the operating member can be reduced in weight.

As another aspect of the invention, additives may be disposed between the outer circumferential surface of the inner wheel and the inner circumferential surface of the outer wheel, and the additives may be retained by a retaining space formed between the outer circumferential surface of the inner wheel and the inner circumferential surface of the outer wheel. The additives may typically represent hard materials such as alumina powder and ceramic powder, but instead of these hard materials, traction grease or coating can also be suitably used.

By provision of the additives between the outer circumferential surface of the inner wheel and the inner circumferential surface of the outer wheel, slippage between the inner wheel and the outer wheel can be controllably reduced. In other words, the additives can controllably enhance the power of transmitting rotation (frictional force) between the inner wheel and the outer wheel so that the capability of transmitting the rotational force from the flywheel to the operating member can be improved. Further, with the construction in which the additives are retained by the retaining space, the additives can be prevented from flowing out to the outside, so that more stable transmitting capability can be obtained.

Further, the retaining space may comprise an oblique groove formed in the outer circumferential surface of the inner wheel and/or the inner circumferential surface of the outer wheel and extending obliquely at a predetermined angle in the circumferential direction. The oblique groove may typically represent a single oblique groove extending continuously in a zigzag line entirely in the circumferential direction all around the circumferential surface of the inner wheel and/or the outer wheel. By such groove, additives disposed between the outer circumferential surface of the inner wheel and the inner circumferential surface of the outer wheel can be distributed all over the contact region between the inner and outer wheels in the circumferential the axial direction, so that more stable transmitting capability can be obtained.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved driving tools and method for using such driving tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
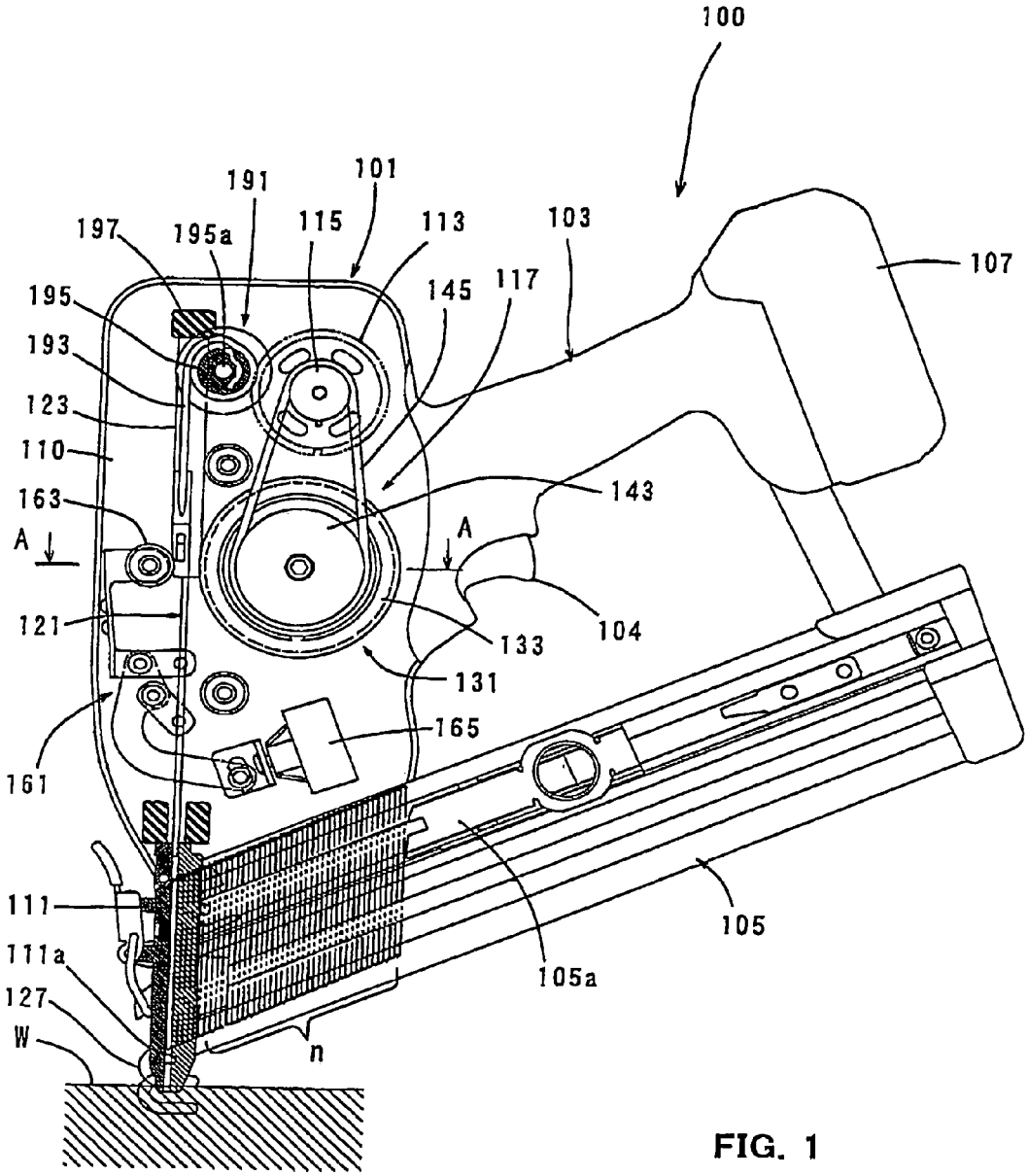
FIG. 1 is a side view showing an entire battery-powered nailing machine according to an embodiment of the invention.
Figure 2:
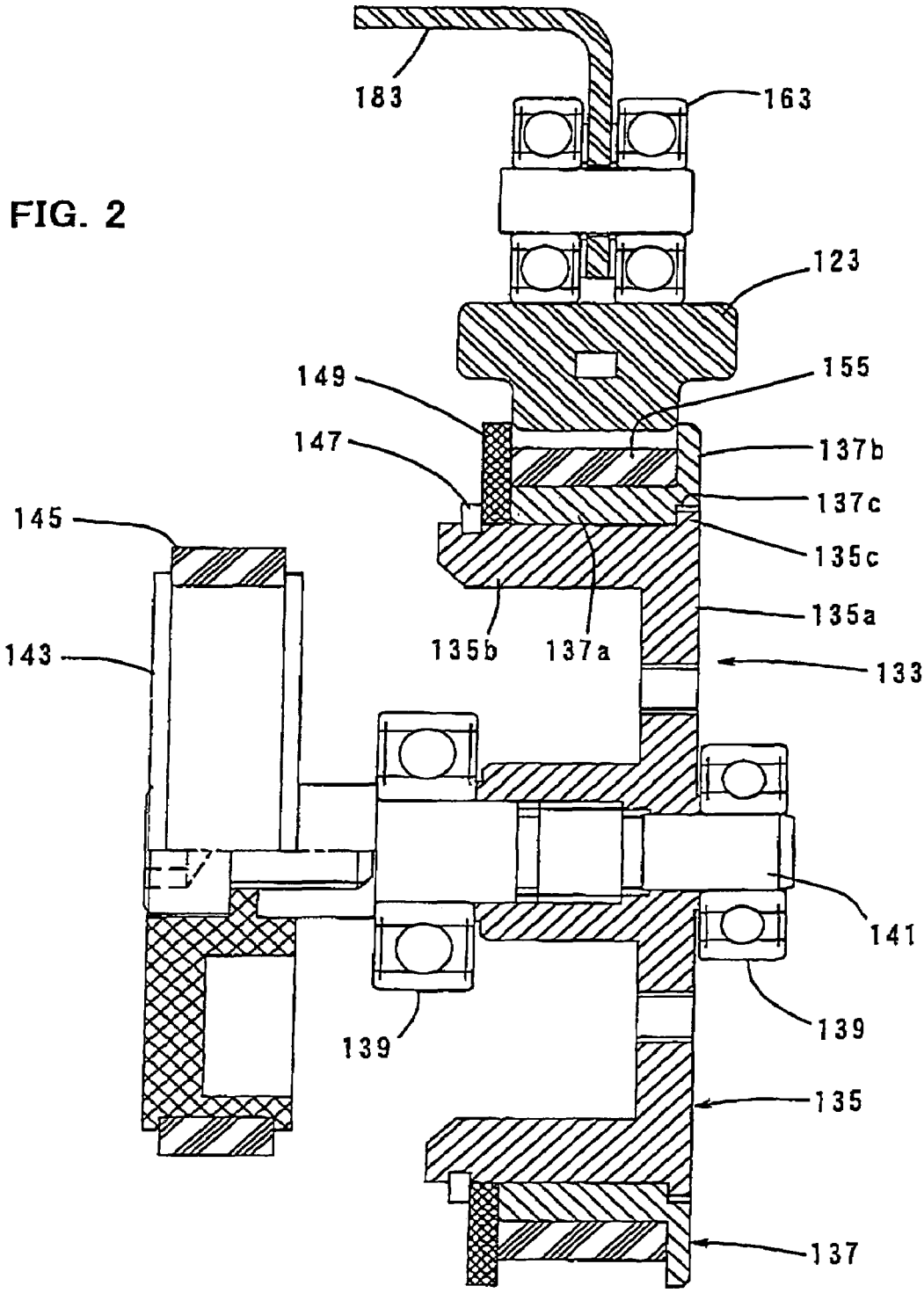
FIG. 2 is a sectional view taken along line A-A in FIG. 1, showing a driver standby state in which a driver support is not yet pressed against a flywheel.
Figure 3:
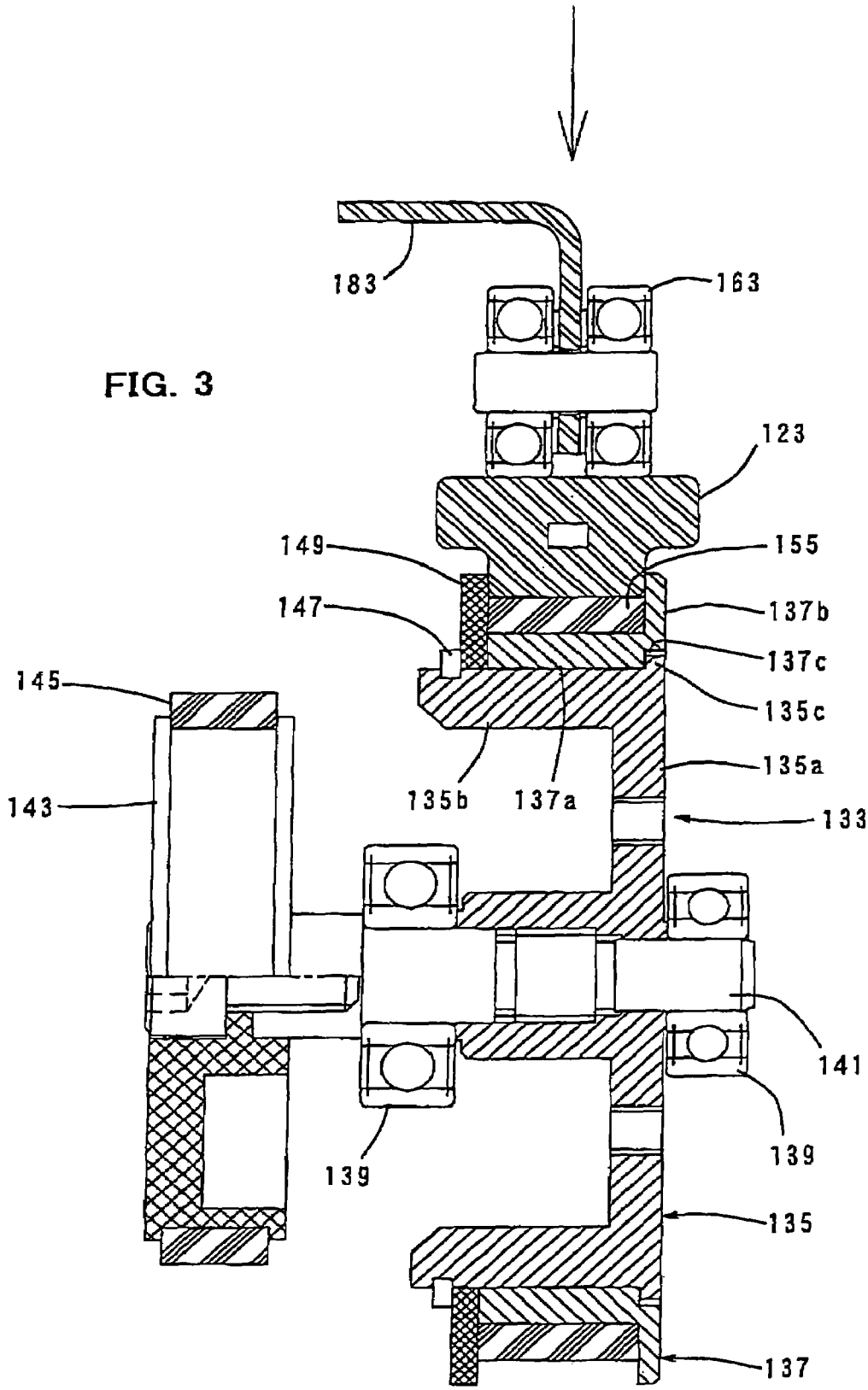
FIG. 3 is a sectional view taken along line A-A in FIG. 1, showing a roller pressing state in which the driver support is pressed against the flywheel.

A representative embodiment of the present invention is now described with reference to drawings. FIG. 1 shows an entire nailing machine 100 as a representative example of a driving tool according to the embodiment of the present invention FIGS. 2 and 3 are sectional views taken along line A-A in FIG. 1, showing a driver driving section. The representative nailing machine 100 includes a body 101, a handle 103 to be held by a user, and a magazine 105 that is loaded with nails n to be driven into a workpiece. The handle 103 is integrally formed with the body 101 and extends laterally from the side of the body 101. A rechargeable battery pack 107 is mounted on the end of the handle 103, and a driving motor 113 is powered from the battery pack 107.

FIG. 1 shows the nailing machine 100 with the tip of the body 101 pointed at a workpiece W. Therefore, in FIG. 1, a nail driving direction (longitudinal direction) in which a nail n is driven and a nail striking direction in which a driver 121 strikes the nail n are downward.

A driver guide 111 is provided on the tip (lower end as viewed in FIG. 1) of the body 101 and forms a nail injection port. The magazine 105 is mounted to extend between the tip of the body 101 and the end of the handle 103, and the end of the magazine 105 on the nail feeding side is connected to the driver guide 111. The magazine 105 has a pressure plate 105*a* for pushing the nails n in the nail feeding direction (leftward as viewed in FIG. 1). The magazine 111 is designed such that the pressure plate 105*a* feeds the nails one by one into a nail injection hole 111*a* of the driver guide 111 from a direction that intersects with the nail driving direction. The nail injection hole 111*a* is formed through the driver guide 111 in the nail driving direction. In this specification, the side of the driver guide 111 is taken as the front and its opposite side is taken as the rear.

The body 101 is generally cylindrically formed of resin and mainly includes a body housing 110 formed of two halves. The body housing 110 houses the driving motor 113 and a nail driving mechanism 117 that is driven by the driving motor 113 and strikes the nail n. The nail driving mechanism 117 mainly includes a driver 121 that reciprocates in a direction parallel to the nail driving direction and strikes the nail n, a drive mechanism 131 that transmits rotation of the driving motor 113 to the driver 121 as linear motion, and a return mechanism 191 that returns the driver 121 to a standby position (initial position) after completion of striking the nail. The standby position is the position to which the driver 121 is returned by the return mechanism 191 and contacts a stopper 197 located in the rear position (the upper position as viewed in FIG. 1) remotest from the driver guide 111.

A driver support 123 is provided generally in the center of the body housing 110 and formed of a rod-like metal material having a generally rectangular section and movable in the direction parallel to the nail driving direction via a slide support mechanism which is not shown. The driver 121 is joined to an end (lower end as viewed in FIG. 1) of the driver support 123 in the nail driving direction. The driver 121 is formed of a rod-like metal material having a generally rectangular section thinner than the driver support 123. The driver 121 extends toward the driver guide 111 and the tip of the driver 121 is located in the inlet (upper opening as viewed in FIG. 1) of the nail injection hole 111*a*. The driver 121 and the driver support 123 are features that correspond to the "operating member" according to this invention.

As shown in FIGS. 2 and 3, the drive mechanism 131 mainly includes a flywheel 133 that is rotationally driven at high speed by the driving motor 113, and a pressure roller 163 that presses the driver support 123 for supporting the driver 121 against the flywheel 133. The flywheel 133 and the pressure roller 163 can rotate on the axis that intersects with the nail driving direction and are disposed on opposite sides of the driver support 123. One side (hereinafter referred to as a "front surface") of the driver support 123 is located close to the outer circumferential surface of the flywheel 133. When the side of the driver support 123 opposite the front surface (hereinafter referred to as a "rear surface") is pressed against the outer circumferential surface of the flywheel 133 by the pressure roller 163, the driver support 123 is functionally engaged with the flywheel 133 that rotates at high speed and thereby caused to move linearly in the nail driving direction.

FIG. 2 shows the driver standby state in which the driver support 123 is not yet pressed against the flywheel 133, and FIG. 3 shows the roller pressing state in which the driver support 123 is pressed against the flywheel 133 by the pressure roller 163. As shown in FIGS. 2 and 3, the flywheel 133 is fixedly mounted on one end of a rotary shaft 141 that is rotatably supported by a bearing 139. A driven pulley 143 is fixedly mounted on the other end of the rotary shaft 141. As shown in FIG. 1, a driving pulley 115 is mounted on an output shaft of the driving motor 113. A driving belt 145 is looped over the driving pulley 115 and the driven pulley 143. When the driving motor 113 is energized, the flywheel 133 is rotationally driven together with the driven pulley 143 via the driving belt 145.

Figure 5:
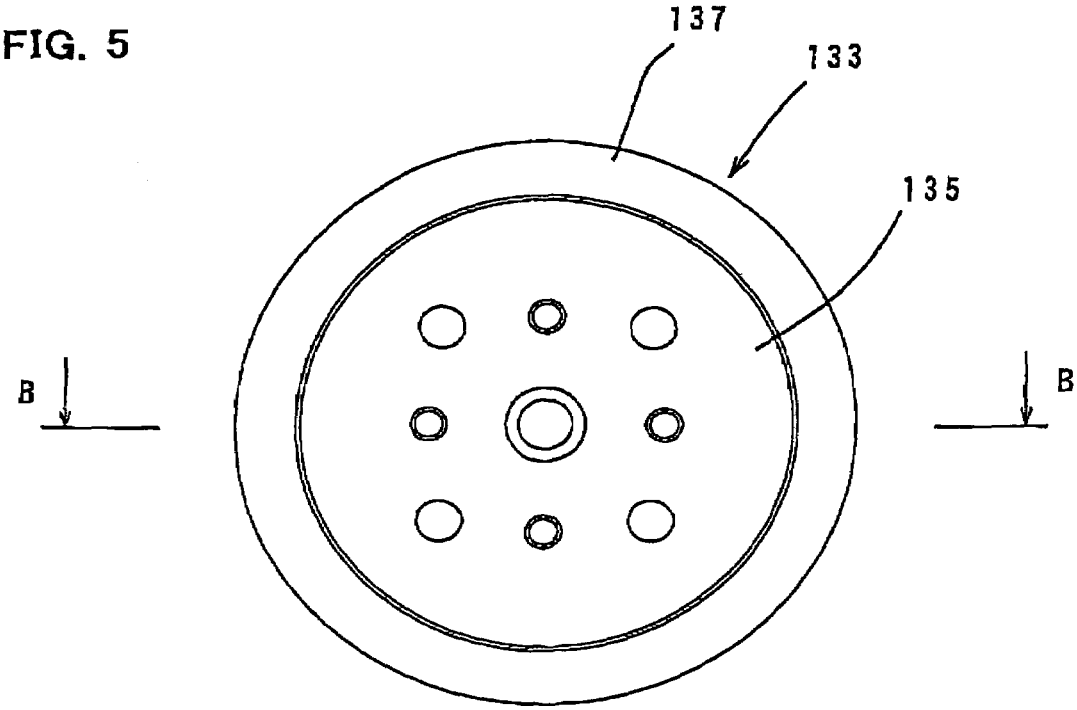
FIG. 5 is a front view of a flywheel assembly.
Figure 6:
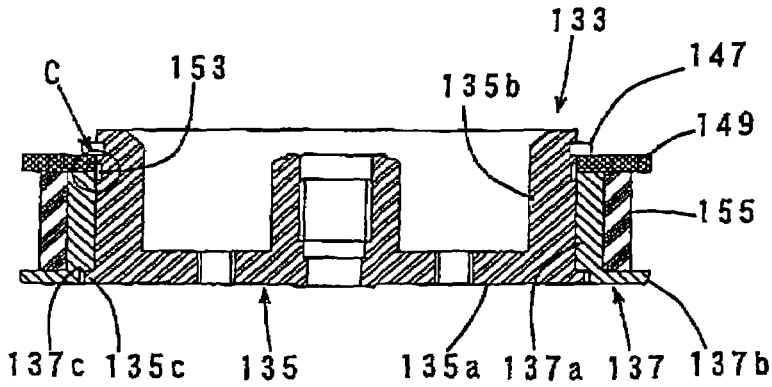
FIG. 6 is a sectional view taken along line B-B in FIG. 5.
Figure 7:
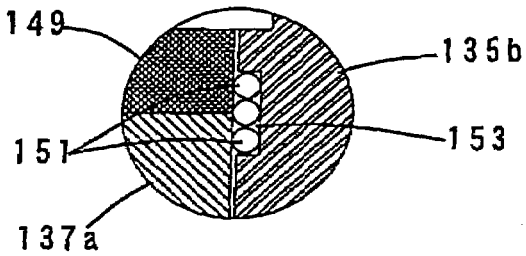
FIG. 7 is an enlarged view of part C in FIG. 6.
Figure 8:
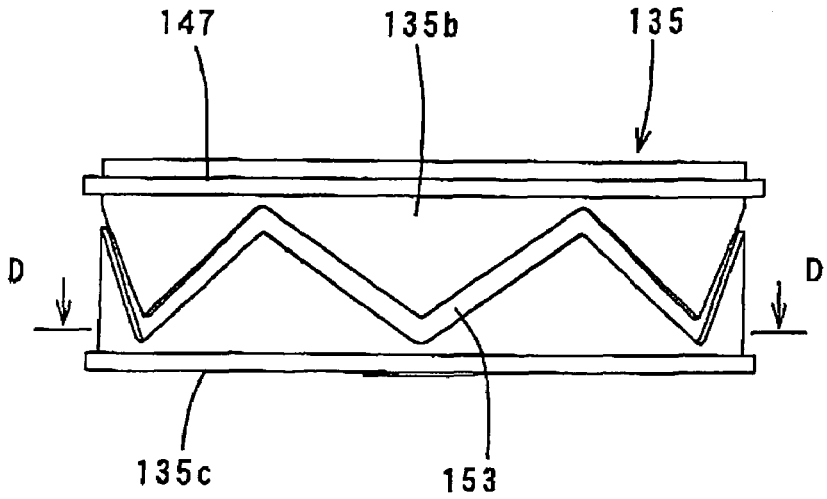
FIG. 8 is a plan view of an inner wheel
Figure 9:
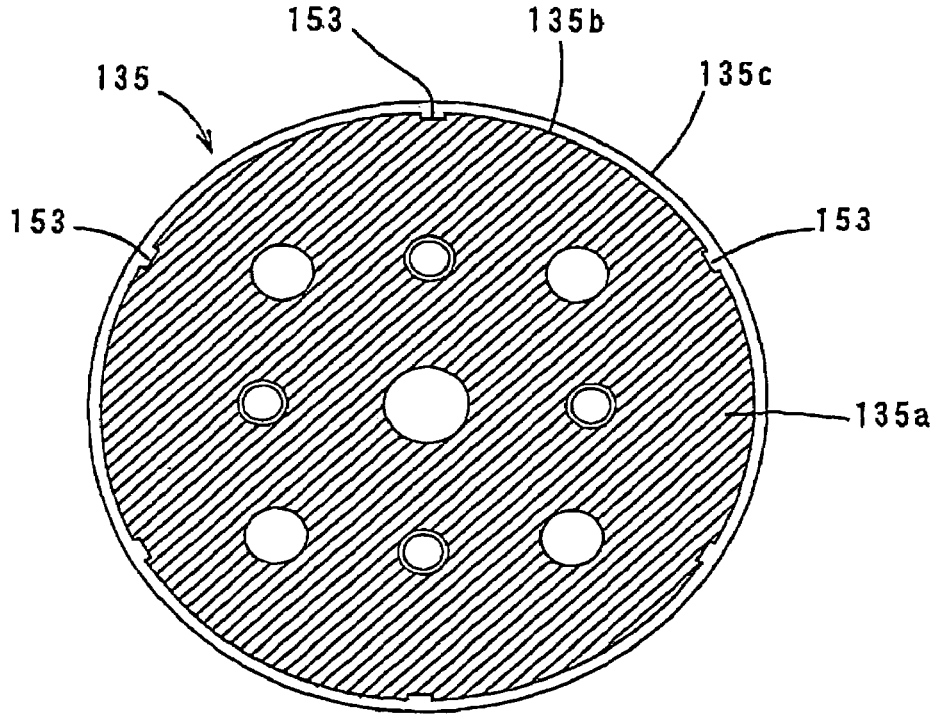
FIG. 9 is a sectional view taken along line D-D in FIG. 8.
Figure 10:
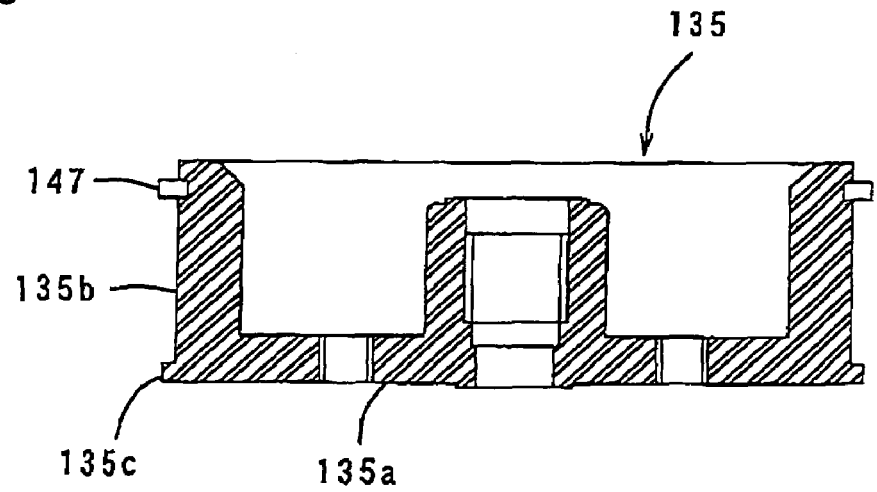
FIG. 10 is a sectional view of the inner wheel.
Figure 11:
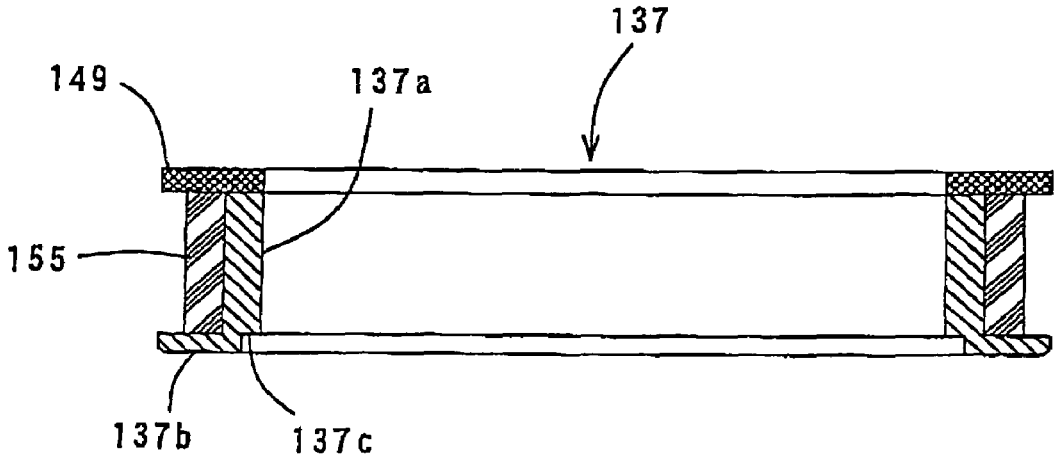
FIG. 11 is a sectional view of an outer wheel.

The flywheel 133 forms a double-layered flywheel assembly having an inner wheel 135 and an outer wheel 137 which are concentrically disposed. FIGS. 5 and 6 show the flywheel assembly, and FIG. 7 is an enlarged view of part C in FIG. 5. Further, FIGS. 8 to 10 show the inner wheel 135, and FIG. 11 shows the outer wheel 137.

The inner wheel 135 includes a disc portion 135*a* and an annular portion 135*b* integrally formed around the perimeter of the disc portion 135*a* and having a predetermined width in the axial direction. The center of the disc portion 135*a* is fixedly mounted on the rotary shaft 141. The outer wheel 137 has a ring-like shape having an annular portion 137*a* of a predetermined width in the axial direction and an outer flange portion 137*b* protruding radially outward from one end of the annular portion 137*a* and having a predetermined height. The inner circumferential surface of the annular portion 137*a* is fitted on the outer circumferential surface of the annular portion 135*b* of the inner wheel 135. The inner wheel 135 and the outer wheel 137 are allowed to rotate in the circumferential direction with respect to each other and prevented from moving in the axial direction with respect to each other. Specifically, on one axial end side of the inner and outer wheels 135, 137, a stepped portion 135*c* is formed on the outside surface of the annular portion 135*b* of the inner wheel 135 and protrudes radially outward, and a notched portion 137*c* is formed in the inside surface of the annular portion 137*a* of the outer wheel 137, so that the notched portion 137*c* contacts the stepped portion 135*c*. Further, on the other axial end side, the other end of the annular portion 137*a* of the outer wheel 137 contacts a retaining ring 147 via an annular ring plate 149. The retaining ring 147 is shaped like a C-ring and fixedly mounted on the annular portion 135*b* of the inner wheel 135. Thus, in the state in which the one axial end of the outerwheel 137 is held in contact with the stepped portion 135*c*, the other axial end of the outer wheel 137 is retained by the retaining ring 147 so as to be prevented from slipping off. With this configuration, the outer wheel 137 can be easily assembled onto the inner wheel 135.

Additives 151 (see FIG. 7) are disposed between the outer circumferential surface of the annular portion 135*b* of the inner wheel 135 and the inner circumferential surface of the annular portion 137*a* of the outer wheel 137. The additives 151 function as a rotational force transmitting member between the inner wheel 135 and the outer wheel 137. Granular hard materials such as alumina powder and ceramic powder are used as the additives 151. As shown in FIG. 8, a generally lightening-shaped oblique groove 153 is formed in the outer circumferential surface of the annular portion 135*b* of the inner wheel 135 and extends in a zigzag line in the circumferential direction. The additives 151 are charged and retained in the oblique groove 153. The oblique groove 153 is a feature that corresponds to the "retaining space" in the present invention. The additives 151 thus interposed between the both annular portions 135*b*, 137*a* enhance the frictional force between the annular portions 135*b*, 137*a*. As a result, the power of transmitting rotation from the inner wheel 135 to the outer wheel 137 when the inner wheel 135 rotates can be enhanced. The number of turns and the inclination of the oblique groove 153 can be appropriately determined.

A rubber ring 155 forms a surface material having a high coefficient of friction and is fitted all around the outer circumferential surface of the annular portion 137*a* of the outer wheel 137. The rubber ring 155 is a feature that corresponds to the "elastic material" in the present invention. In order to integrally form the rubber ring 155 on the outer circumferential surface of the annular portion 137*a*, the rubber ring 155 may be formed in a ring-like shape in advance and joined to the outer circumferential surface of the annular portion 137*a* by adhesives, or it may be directly formed on the outer circumferential surface of the annular portion 137*a*. By provision of the rubber ring 155 having a high coefficient of friction on the outer circumferential surface of the outer wheel 137, the frictional force which is caused between the rubber ring 155 and the driver support 123 when the driver support 123 contacts (is pressed against) the rubber ring 155 is increased. The frictional force between the rubber ring 155 and the driver support 123 is set to be larger than the frictional force between the annular portion 135*b* of the inner wheel 135 and the annular portion 137*a* of the outer wheel 137.

As shown in FIGS. 1 to 3, the flywheel 133 thus constructed is placed such that the outer circumferential surface of the rubber ring 155 faces the front surface of the driver support 123. TIe outer circumferential surface of the rubber ring 155 is parallel to the axis of the rotary shaft 141 and opposed in parallel to the front surface of the driver support 123 with a slight clearance therebetween as shown in FIG. 2.

Figure 4:
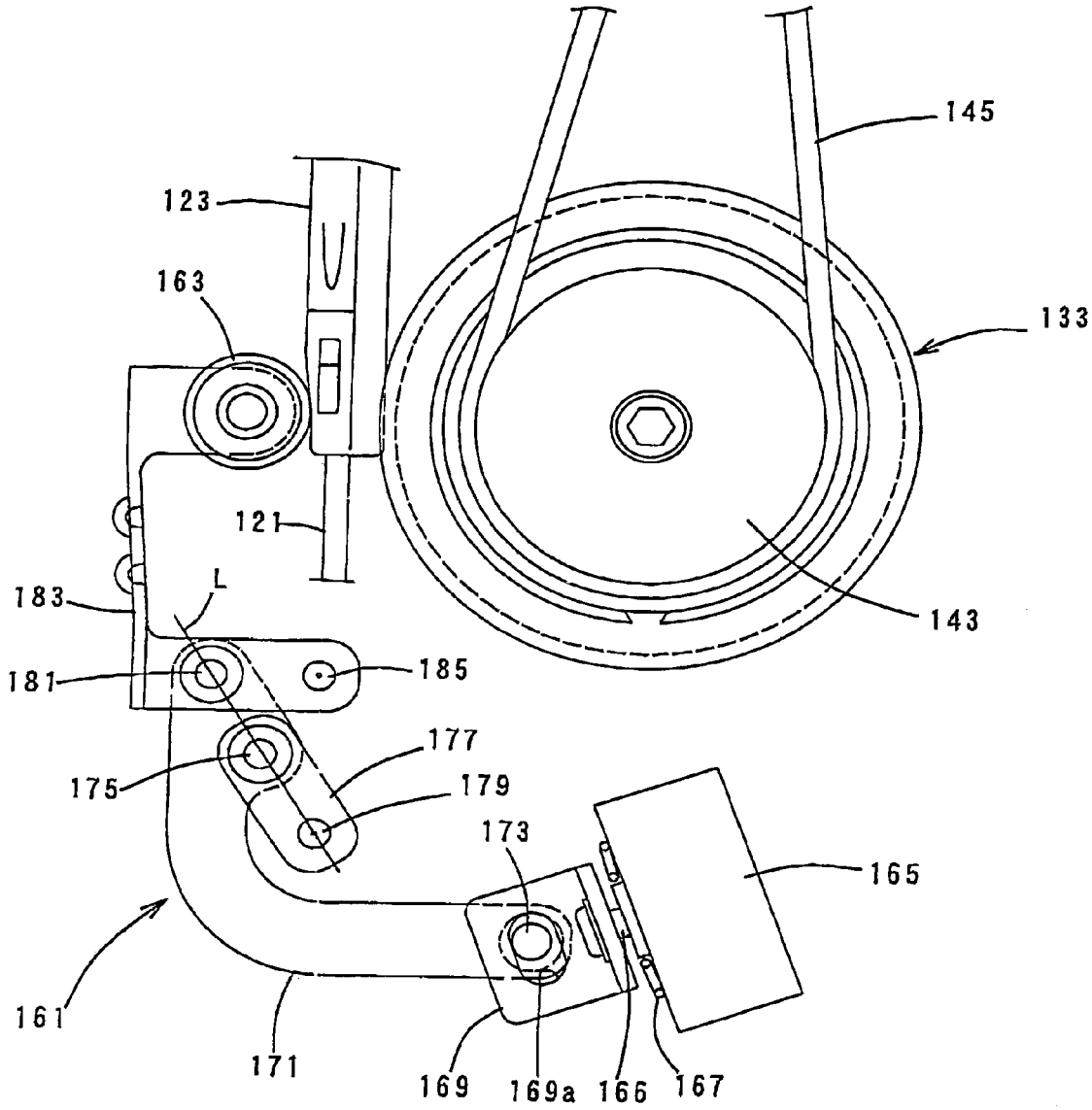
FIG. 4 is a side view showing a pressing mechanism for a driver.

Further, as shown in FIGS. 1 and 4, the drive mechanism 131 includes a pressing mechanism 161 that presses the driver support 123 against the flywheel 133 via the pressure roller 163. The pressing mechanism 161 has an electromagnetic actuator 165 disposed in the front part (lower part as viewed in FIG. 1) within the body housing 110. An output shaft 166 of the electromagnetic actuator 165 is biased toward the protruded position by a compression spring 167. When the electromagnetic actuator 165 is energized, the output shaft 166 moves toward the retracted position against the biasing force of the compression spring 167. While, when the electromagnetic actuator 165 is de-energized, the output shaft 166 is returned to the protruded position by the compression spring 167.

One end of an actuating arm 171 is connected to the end of the output shaft 166 of the electromagnetic actuator 165 for relative rotation via a bracket 169. A connecting hole 169*a* is formed in the bracket 169 and elongated in the direction perpendicular to the direction of movement of the output shaft 166. The actuating arm 171 is connected to the bracket 169 via a connecting shaft 173 inserted through the connecting hole 169*a*. Therefore, the one end of the actuating arm 171 is connected to the bracket 169 such that it can rotate via the connecting shaft 173 and such that the center of rotation of the actuating arm 171 can be displaced within the range in which the connecting shaft 173 serving as the center of the rotation can move in the connecting hole 169*a*.

The actuating arm 171 is bent in an L-shape and extends rearward (upward as viewed in FIG. 1). One end of a control arm 177 is rotatably connected to the other end of the actuating arm 171 via a first movable shaft 175. The control arm 177 is rotatably connected to the body housing 110 via a first fixed shaft 179. Further, the other end of the actuating arm 171 is rotatably connected to a pressure arm 183 via a second movable shaft 181. The pressure arm 183 is rotatably supported by the body housing 110 via a second fixed shaft 185. The pressure roller 163 is rotatably supported on the rotating end (the upper end as viewed in FIGS. 1 and 5) of the pressure arm 183.

In the pressing mechanism 161 thus constructed, in the standby state as shown in FIG. 1, the electromagnetic actuator 165 is de-energized and thus the output shaft 166 is returned to the protruded position by the pressure spring 167. In this standby state, the proximal end (on the side of the connecting shaft 173) of the actuating arm 171 is displaced obliquely downward right as viewed in FIG. 1. Therefore, the control arm 177 rotates on the first fixed shaft 179, so that the pressure roller 163 cannot press (is disengaged from) the back of the driver support 123. As a result, the front of the driver support 123 is disengaged from the outer circumferential surface of the rubber ring 155 of the flywheel 133. This state is shown in FIG. 2.

When the electromagnetic actuator 165 is energized, the output shaft 166 is returned to the retracted position against the biasing force of the pressure spring 167. At this time, the proximal end of the actuating arm 171 is moved obliquely upward left (as viewed in FIG. 1). Then, the control arm 177 rotates clockwise on the first fixed shaft 179, and the pressure arm 183 rotates clockwise on the second fixed shaft 185. Therefore, the pressure roller 163 presses the back of the driver support 123, so that the front of the driver support 123 is pressed against the rubber ring 155 of the flywheel 133. This state is shown in FIG. 3. At this time, the first fixed shaft 179 of the control arm 177, the first movable shaft 175 serving as a connecting point between the control arm 177 and the actuating arm 171, and the second movable shaft 181 serving as a connecting point between the actuating arm 171 and the pressure arm 183 lie on a line L. This state is shown in FIG. 4. Thus, the pressure arm 183 is locked in the state in which the driver support 123 is pressed against the flywheel 133 by the pressure roller 163. Specifically, the pressing mechanism 161 locks the pressure roller 163 in the pressed position by means of a toggle mechanism which is formed by the first fixed shaft 179, the first movable shaft 175 and the second movable shaft 181. In this manner, the pressing mechanism 161 holds the driver support 123 pressed against the rubber ring 155 of the flywheel 133. When the driver support 123 is pressed against the rubber ring 155 of the flywheel 133 rotating at high speed, the driver 121 is caused to move at high speed toward the driver guide 111 together with the driver support 123 by the rotational energy of the flywheel 133. The driver 121 then strikes the nail n and drives it into the workpiece.

Next, the return mechanism 191 that returns the driver 121 to the standby position after completion of striking the nail n is now be explained. The return mechanism 191 mainly includes right and left return rubbers 193, right and left winding wheels 195 for winding the return rubbers 193, and a fiat spiral spring (now shown) for rotating the winding wheels 195 in the winding direction. The winding wheels 195 are disposed in the rear region (the upper region as viewed in FIG. 1) of the body housing 110 and rotate together with one winding shaft 195*a* rotatably supported by a bearing. The flat spiral spring is disposed on the winding shaft 195*a*. One end of the flat spiral spring is anchored to the body housing 110, and the other end is anchored to the winding shaft 195*a*. The flat spiral spring biases the winding wheels 195 in the winding direction together with the winding shaft 195*a*. One end of each of the right and left return rubbers 193 is anchored to the associated right or left winding wheel 195, and the other end is anchored to the associated side surface of the driver support 123. The driver 121 is pulled by the return rubber 193 together with the driver support 123 and retained in the standby position in contact with the stopper 197.

A contact arm 127 is provided on the driver guide 111 and actuated to turn on and off a Contact arm switch (which is not shown) for energizing and denergizing the driving motor 113. The contact arm 127 is mounted movably in the longitudinal direction of the driver guide 111 (the longitudinal direction of the nail n) and biased in such a manner as to protrude from the end of the driver guide 111 by a spring which is not shown. When the contact arm 127 is in the protruded position, the contact arm switch is in the off position, while, when the contact arm 127 is moved toward the body housing 110, the contact arm switch is turned on. Further, a trigger 104 is provided on the handle 103 and designed to be depressed by the user and returned to its initial position by releasing the trigger. When the trigger 104 is depressed, a trigger switch (not shown) is turned on and the electromagnetic actuator 165 of the pressing mechanism 161 is energized When the trigger 104 is released, the trigger switch is turned off and the electromagnetic actuator 165 is de-energized.

Operation and usage of the nailing machine 100 constructed as described above is now be explained. When the user holds the handle 103 and presses the contact arm 127 against the workpiece W, the contact arm 127 is pushed by the workpiece and retracts toward the body housing 110. Thus, the contact arm switch is turned on and the driving motor 113 is energized. The rotating output of the driving motor 113 is transmitted to the inner wheel 135 of the flywheel 133 via the driving pulley 115, the driving belt 145 and the driven pulley 143. Then, while the inner wheel 135 rotates, the outer wheel 137 is caused to rotate together with the inner wheel 135 by the frictional force (sliding resistance) which is caused by the additives 151 disposed between the inner wheel 135 and the outer wheel 137. Thus, the flywheel 133 is rotationally driven at a predetermined rotation speed.

In this state, when the trigger 104 is depressed, the trigger switch is turned on and the electromagnetic actuator 165 is energized and actuated in the direction that retracts the output shaft 166. As a result, the actuating arm 171 is displaced, and the pressure arm 183 rotates on the second fixed shaft 185 in the pressing direction and presses the back of the driver support 123 with the pressure roller 163. The driver support 123 pressed by the pressure roller 163 is pressed against the rubber ring 155 which forms the outer circumferential surface of the flywheel 133. Therefore, the driver 121 is caused to move linearly in the nail driving direction together with the driver support 123 by the rotational force of the flywheel 133. The driver 121 then strikes the nail n with its tip and drives it into the workpiece. At this time, the return rubber 193 is wound off the winding wheel 195 and the flat spiral spring is wound up.

When the trigger 104 is released after completion of driving the nail n by the driver 121, the electromagnetic actuator 165 is de-energized. As a result, the output shaft 166 of the electromagnetic actuator 165 is returned to the protruded position by the compression spring 167, and thus the actuating arm 171 is displaced. When the actuating arm 171 is displaced, the first movable shaft 175 is displaced off the line connecting the first fixed shaft 179 and the second movable shaft 181, so that the toggle mechanism is released. Further, the pressure arm 183 is caused to rate counterclockwise on the second fixed shaft 185, so that the pressure roller 163 is disengaged from the driver support 123 and cannot press the driver support 123. Upon disengagement of the pressure roller 163, the driver support 123 is pulled by the return rubber 193 and returned to the standby position in contact with the stopper 197 as shown in FIG. 1. The return rubber 193 has its own elasticity for contraction, and it is wound up by the winding wheel 195 spring-biased in the winding direction. Therefore, even if the driver support 123 is moved in a large stroke in the nail driving direction, the driver support 123 can be reliably returned to its standby position. Further, permanent set of the return rubber 193 in fatigue can be reduced, so that the durability can be enhanced.

In this embodiment, the flywheel 133 has a double-layered structure having the inner wheel 135 and the outer wheel 137. The rubber ring 155 is provided on the outer circumferential surface of the outer wheel 137, and the frictional force between the outer circumferential surface of the outer wheel 137 and the driver support 123 is set to be larger than the frictional force between the outer circumferential surface of the inner wheel 135 and the inner circumferential surface of the outer wheel 137. Therefore, when the driver support 123 is pressed against the rubber ring 155 by the pressure roller 163, the rubber ring 155 is integrated with the driver support 123. Specifically, the rubber ring 155 elastically deforms according to the surface condition (irregularity) of the contact surface of the driver support 123. Thus, the area of contact of the driver support 123 and the rubber ring 155 is increased, so that the frictional force therebetween increases. As a result, the outer wheel 137 and the driver support 123 hardly cause slippage with respect to each other, or in other words, they are integrated together. Therefore, friction in the contact region is prevented or reduced and thereby the durability can be increased.

Further, with the construction in which the rubber ring 155 contacts the driver support 123, it is not necessary to provide the driver support 123 with unnecessarily high strength or wear resistance. Therefore, the contact region between the driver support 123 and the rubber ring 155 can be formed, for example, of aluminum, so that the driver support 123 can be reduced in weight. Further, in this embodiment, the outer wheel 137 directly contacts the driver support 123 without another rotating element intervening therebetween and thereby transmits the rotational force by the frictional force. With this construction, the mechanism can be simplified and the number of component parts can be reduced, compared, for example, with a construction in which the rotational force of the flywheel 133 is transmitted to the driver support 123 via an intermediate rotating element.

Further, the frictional force between the outer wheel 137 and the inner wheel 135 is set to be smaller Man the frictional force between the driver support 123 and the outer wheel 137. Therefore, slippage is caused between the outer wheel 137 and the inner wheel 135 when the driver support 123 is pressed against the rubber ring 155 of the outer wheel 137. In this case, the inner circumferential surface of the outer wheel 137 and the outer circumferential surface of the inner wheel 135 which have about the same curvature are fitted together, so that the area of contact therebetween is increased. Therefore, stress which acts upon the inner wheel 135 and the outer wheel 137 when the driver support 123 is pressed against the flywheel 133 by the pressure roller 163 is spread. As a result, wear of the flywheel 133 and the driver support 123 can be reduced, so that their durability can be increased.

As described above, according to this embodiment, it is configured such that, when the driver support 123 is pressed against the flywheel 133 rotating at high speed, slippage which may be caused between the flywheel 133 and the driver support 123 is caused between the inner circumferential surface of the outer wheel 137 and the outer circumferential surface of the inner wheel 135 which provide a large contact area therebetween. As a result, the nailing machine 100 is provided in which the flywheel 133 and the driver support 123 have higher durability.

Further, in this embodiment, the additives 151 are disposed between the outer circumferential surface of the inner wheel 135 and the inner circumferential surface of the outer wheel 137. With this arrangement, the power of transmitting rotation (the Frictional force) between the inner wheel 135 and the outer wheel 137 can be enhanced, so that the capability of transmitting the rotational force from the flywheel 133 to the driver support 123 can be improved. Further, in this embodiment, the additives 151 are retained by the oblique groove 153 formed in the outer circumferential surface of the inner wheel 135. With this arrangement, the additives 151 can be prevented from flowing out to the outside, so that stable transmission can be ensured for a longer period of time. Further, the oblique groove 153 is formed in the outer circumferential surface of the inner wheel 135 and extends in the circumferential direction in a zigzag line. Therefore, the additives 151 can be distributed all over the inner wheel 135 in the circumferential and axial directions. Specifically, the additives 151 can be evenly disposed all over the outer circumferential surface of the inner wheel 135, so that more stable transmitting capability can be obtained. The additives 151 may be disposed at least in any one of outer circumferential surface of the inner wheel 135 and the inner circumferential surface of the outer wheel 137.

Further, in this embodiment, the frictional force between the outer wheel 137 and the driver support 123 is made larger than the frictional force between the inner wheel 135 and the outer wheel 137 by changing the material of the outer circumferential surface of the outer wheel 137. However, the difference between the frictional forces may be made by the surface condition (roughness) of the contact surface. Further, in this embodiment, granular hard materials such as alumina powder and ceramic powder are used as the additives 151 between the inner wheel 135 and the outer wheel 137. Instead of using alumina powder or ceramic powder, however, traction grease (grease which forms a grass film on the contact surface) may be enclosed, or the outer circumferential surface of the inner wheel 135 may be covered with a carbon coating. Further, the grease to be enclosed is not limited to traction grease, but any grease which can increase the contact force between the members may be used.

Further, in this embodiment, the retaining space for retaining the additives 151 is formed by the generally lightening-shaped single oblique groove 153 extending in a zigzag line in the circumferential direction. However, it may be formed by other modified configurations, including a plurality of the zigzag oblique grooves 153 extending in the circumferential direction, a plurality of linear oblique grooves arranged in parallel in the circumferential direction, a plurality of oblique grooves intersecting with each other, a plurality of linear grooves extending in parallel in the axial direction, one or more linear grooves extending linearly in the circumferential direction, and a plurality of linear grooves intersecting with each other in the axial and circumferential directions. Further, in this embodiment, the battery-powered nailing machine 101 is described as a representative example of the driving tool but this invention can also be applied to any other driving tools of the type which utilizes the rotational energy of the flywheel 133 to linearly drive the driver 121 in the nail driving direction.

DESCRIPTION OF NUMERALS

100 nailing machine (driving tool)
101 body
103 handle
104 trigger
105 magazine
107 battery pack
110 body housing
111 driver guide
111*a* nail injection hole
113 driving motor
115 driving pulley
117 nail driving mechanism
121 driver
123 driver support
127 contact arm
131 drive mechanism
133 flywheel
135 inner wheel
135*a* disc portion
135*b* annular portion
135*c* stepped portion
137 outer wheel
137*a* annular portion
137*b* outer flange portion
137*c* notched portion
139 bearing
141 rotary shaft
143 driven pulley
145 driving belt
147 retaining ring
149 ring plate
151 additive
153 oblique groove (retaining space)
155 rubber ring (elastic material)
161 pressing mechanism
163 pressure roller
165 electromagnetic actuator
166 output shaft
167 compression spring
169 bracket
169*a* connecting hole
171 actuating arm
173 connecting shaft
175 first movable shaft
177 control arm
179 first fixed shaft
181 second movable shaft
183 pressure arm
185 second fixed shaft
191 return mechanism
193 return rubber
195 winding wheel
195*a* winding shaft
197 stopper

What we claim is:

1. A driving tool comprising:

an elongated operating member that drives in a driving material by a reciprocating movement; and a drive mechanism that drives the operating member, wherein the drive mechanism comprises a flywheel that rotates, the flywheel including an inner wheel and an outer wheel which are concentrically disposed to each other, an inner circumferential surface of the outer wheel is fitted on an outer circumferential surface of the inner wheel, and an outer circumferential surface of the outer wheel directly contacts the operating member, whereby a rotational force of the flywheel is transmitted from the inner wheel to the operating member via the outer wheel and the drive mechanism linearly moves, and wherein a frictional force between the outer circumferential surface of the inner wheel and the inner circumferential surface of the outer wheel is smaller than a frictional force between the outer circumferential surface of the outer wheel and the operating member during all times of operation of the driving tool.

2. The driving tool as defined in claim 1, wherein slippage is caused between the outer wheel and the inner wheel when the outer circumferential surface of the outer wheel contacts the operating member.

3. The driving tool as defined in claim 1, wherein an elastic material is disposed on the outer circumferential surface of the outer wheel and at least a contact region of the operating member which contacts the outer wheel is formed of metal.

4. The driving tool as defined in claim 1, wherein additives are disposed between the outer circumferential surface of the inner wheel and the inner circumferential surface of the outer wheel, and the additives are retained within a retaining space formed between the outer circumferential surface of the inner wheel and the inner circumferential surface of the outer wheel.

5. The driving tool as defined in claim 4, wherein granular hard materials are used as the additives.

6. The driving tool as defined in claim 4, wherein the retaining space comprises an oblique groove formed in the outer circumferential surface of the inner wheel and/or the inner circumferential surface of the outer wheel and extending obliquely at a predetermined angle in a circumferential direction.

7. The driving tool as defined in claim 6, wherein the oblique groove is defined by a single groove formed in the outer circumferential surface of the inner wheel and/or in the inner circumferential surface of the outer wheel to extend in a zigzag line in the circumferential direction of the inner wheel and/or the outer wheel.

8. The driving tool as defined in claim 6, wherein the oblique groove is provided substantially entirely in a circumferential and an axial direction of at least one of the outer circumferential surface of the inner wheel and the inner circumferential surface of the outer wheel.

9. The driving tool as defined in claim 1, wherein one axial end region of the outer wheel fitted on the inner wheel contacts a stepped portion formed on one axial end region of the outer circumferential surface of the inner wheel and protrudes radially outward, and in this state, the other axial end region of the outer wheel is retained so as to be prevented from slipping off the inner wheel by a retaining ring fixedly mounted on an other axial end region of the inner wheel.

10. The driving tool as defined in claim 1, further comprising an electrically driven nailing machine having a motor that drives the flywheel to rotate.

* * * * *